United States Patent [19]

Nuebling, Sr.

[11] 4,346,899

[45] Aug. 31, 1982

[54] BOARD GAME FEATURING OLYMPIC SPORTS

[76] Inventor: George E. Nuebling, Sr., Box 940, Rte. 1, Hollywood, Md. 20636

[21] Appl. No.: 187,483

[22] Filed: Sep. 16, 1980

[51] Int. Cl.[3] ..... A63F 3/00

[52] U.S. Cl. ..... 273/244; 273/290

[58] Field of Search ..... 273/244, 246, 290

[56] References Cited

U.S. PATENT DOCUMENTS

| | | | |
|---|---|---|---|
| 2,026,082 | 12/1935 | Darrow | 273/134 |
| 3,880,429 | 4/1975 | Blermenaus | 273/DIG. 30 |
| 3,902,724 | 9/1975 | Hersey | 273/131 AB |
| 4,010,957 | 3/1977 | Tricoli | 273/134 AD |
| 4,062,545 | 12/1977 | Witney | 273/246 |
| 4,082,289 | 4/1978 | Merritt | 273/246 |
| 4,121,823 | 10/1978 | McBride | 273/249 |
| 4,141,560 | 2/1979 | Kaslow | 273/244 |

FOREIGN PATENT DOCUMENTS

| | | | |
|---|---|---|---|
| 1814111 | 6/1970 | Fed. Rep. of Germany | 273/244 |
| 2512026 | 1/1976 | Fed. Rep. of Germany | 273/290 |
| 764210 | 1/1956 | United Kingdom | 273/244 |
| 1384848 | 2/1975 | United Kingdom | 273/244 |

*Primary Examiner*—Richard C. Pinkham
*Assistant Examiner*—Carl Moy
*Attorney, Agent, or Firm*—Eugene F. Osborne, Sr.

[57] ABSTRACT

A game features competitive sports in track and field, water, winter and arena events. The apparatus comprises a playing board, at least four two-piece magnetic playing pieces, five sets of playing cards, a die, a spinner and game instructions. The playing board comprises a two-dimensional area having a zoned section around the perimeter thereof upon which players advance among a plurality of contiguous spaces, the inscription for each station providing a random distribution of penalties or bonuses in advancing play or in calculating score and instructions to the players including directions diverting play into the major event. It has a spinner located centrally. The remaining area is divided in quadrants, each having a course for play and an area for an associated deck of cards. Each event quadrant contains playing stations arranged in a path from start to finish. Event cards identify a sport and set values for winning medals. A special card may direct a player's next move, grant a bonus or impose a penalty. Playing pieces have two parts, a pedestal and a figurine. The parts are held together magnetically. The figurine is used alone in advancing in a sports event, the combined pedestal and figurine is for advancing in the principal course at the perimeter zone. While playing an event the pedestal marks the last space in player's progress along the perimeter course for player's return thereto on conclusion of the event. The object of the game is to win by scoring the most points in a fixed time or to win by being the first player to score a set number of points.

2 Claims, 6 Drawing Figures

Copyright © 1980 George E. Nuebling, Sr.

BOARD GAME FEATURING OLYMPIC SPORTS

BACKGROUND OF THE INVENTION

1. Field of the Invention

This invention relates to game boards for entertainment and instructional purposes and particularly to a game involving a multiplicity of athletic sports as played in international competition by individuals and teams.

2. Description of the Prior Art

Board games involving specific subject matter or activities such as property ownership, stock or commodity market operations and sports are known where playing pieces are moved over a pattern of playing spaces to achieve a game objective. Examples of typical games in the prior art that have relevance to the present invention are:

a. U.S. Pat. No. 4,141,560 Feb. 27, 1979 Kaslow

A gameboard has a plurality of separate and unrelated laying courses each simulating a sports event such as baseball, weightlifting, obstacle course, swimming and track.

b. U.S. Pat. No. 3,902,724 May 21, 1974 Hersey

A game related to vehicular traffic uses a playing board having a checkered squares pattern upon which a multiplicity of game pieces are manuevered. Certain of the game pieces are constructed so as to be stackable for purposes of controlling players' movements; i.e. stop and go in a street simulation.

U.S. Pat. No. 4,121,823 Oct. 24, 1978 McBride

This game uses a continuous playing course around the perimeter of the board and a combination of a die, spinner and cards for directing players' movements. Cards also serve an educational purpose with questions related to teach subject matter in a plurality of areas of a major topic, such as religion in the preferred embodiment.

d. U.S Pat. No. 4,010,957 Mar. 8, 1977 Tricoli

The game relates to team sports and the acquisition of teams and players. The course is continuous around the perimeter of the board. Playing pieces have the form of sports equipment, player figurines, and team markers.

e. U.S. Pat. No. 2,026,082 Dec. 31, 1935 Darrow

The game relates to barter and trade in real estate. A continuous playing course is arranged around the perimeter of the game board. Cards and dice are used in directing players' moves on the course.

SUMMARY OF THE INVENTION

The preferred embodiment of the present invention is intended to foster an awareness of international individual and team sports as played quadrennially in the Olympic Games to provide entertainment and amusement for a limited number of persons while at the same time providing a vehicle for teaching special aspects of the various sports in the major events.

A rectangular game board has a principal playing course forming a continuous pattern of contiguous spaces arranged about the perimeter and four similar but irregular secondary courses arranged symmetrically along the diagonals of the board with a small area at the center of the board reserved for placement thereon of a spinning number generator. Each of the secondary courses is reserved for game play related to one of the four Event classifications; namely, Track and Field, Winter, Water and Arena Sports. Except where otherwise specifically directed the spinning number generator is used for player moves on the secondary courses while a random number generator, i.e. a die, is used for player moves on the peripheral principal course.

The principal course has 44 spaces each inscribed with game information. Several spaces require a player arriving thereon to go to the secondary courses for Sports Event play. In some instances the player will have an option to challenge other players and in other instances there is a mandatory requirement to so challenge other players. Challenged players must compete unless they are already playing an Event Sport, are presently situated on a sanctuary (or safe area) spaces or possess a "right to refuse challenge" card from the Special Deck.

Each secondary course has 23 numbered spaces in addition to a start space. The last three spaces are inscribed Bronze Medal, Silver Medal and Gold Medal in keeping with winner's awards in the Olympic Games. Associated with each secondary course is a deck of Sports Events Cards, having 21 cards in each deck. Each card represents a particular individual or team contest in the Major Olympic Event and assigns values to the Gold, Silver and Bronze medals for game scoring. Associated also with game play in all of the secondary courses is a deck of Special Cards which serves to award points, impose scoring penalties, direct players' moves and as aforementioned grant a "right to refuse challenges."

Each player is provided a matched two-part playing piece consisting of a pedestal and a sports figurine which are held together by a magnetic bond for making player's moves on the principal course. When playing a SPORTS EVENT on a secondary course the pedestal is left at the last occupied space on the principal course while the figurine is used to mark the player's moves in the SPORTS EVENT. When play on the secondary course ends the figurine is returned to join its matched pedestal and play resumes from the occupied space on the principal course.

The general game objective is to Win. One objective is to score the greatest number of points in a set playing time. A second objective is to score a set amount of points in the shortest time. A third possible objective is to be first in a race to complete one or more full passages of the primary course returning to the START space thereon.

Variations in the embodiment of the game and the method of play are foreseen within the scope of the present invention.

DESCRIPTION

Figure 1:
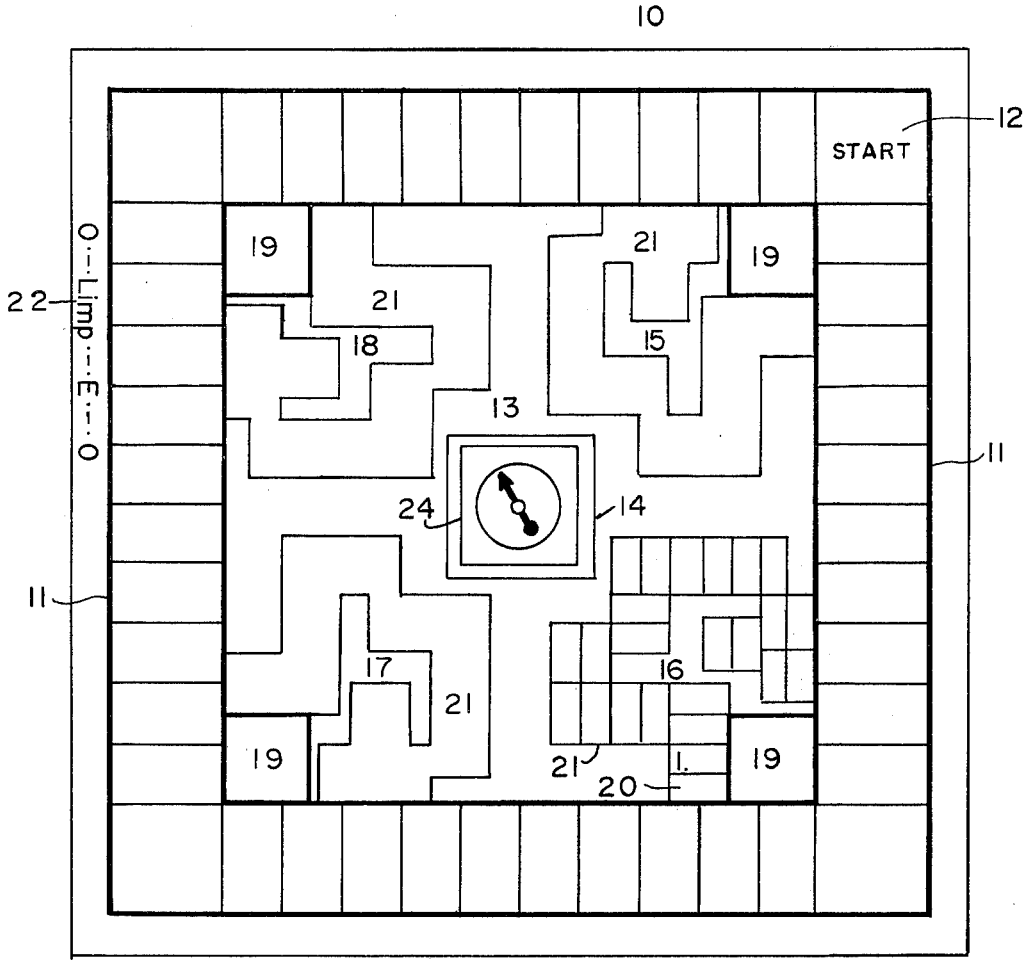
FIG. 1 illustrates the layout of playing zones of the game board.

The game board 10 as shown in FIG. 1 contains five playing courses. The principal course 11 occupies an area around the perimeter of the board in which forty-four stations, each having black on white inscriptions thereon, are arranged continuously to form a closed course for play with a start space 12 located at the upper right corner of the board 10. The interior area of the board 10 is divided into five zones. The central zone 13 provides a place 14 to locate the spinner shown separately in FIG. 3. The remainder of the interior area, dedicated to sports events, is divided into quadrants representing zones, for Track and Field Sports 15, Winter Sports 16, Arena Sports 17 and Water Sports 18.

Each quadrant has an area 19 for associated event cards, a designated start space 20 and a course 21 of random directivity having twenty-three playing spaces. The inscription of the card area 19 is black on white, the start position 20 and the playing course 21 are both red on white. The geometry of the events playing course 21 and the inscriptions of the twenty-three playing spaces are the same in each of the four quadrants.

For the card area 19 the inscriptions in the four quadrants are:

Track and Field Event Cards
Winter Sports Event Cards
Arena Sports Summer and Winter Event Cards
Water Sports Event Cards In the start space 20 the inscriptions follow:

Start Track and Field Sports
Start Winter Sports
Start Arena Sports
Start Water Sports For the numbered spaces of the standardized event playing course 21 the inscriptions are:

Station
1. False Start Lose 2 points.
2.
3. First Round Leader Gain 3 points.
4. Broke World Record Gain 5 points.
5. First Round Last Place—go back 3 spaces.
6. Gain 5 points.
7.
8. Pick a Special Card.
9. Get Second Wind—Go Ahead 3 spaces.
10. Showing Poor Form—Lose a turn.
Station
11. You Endorse a Product—Gain 3 points.
12. You're the Crown Favorite—Go Ahead 2 spaces.
13. You are featured on TV—Gain 2 points.
14.
15. Pick a Special Card.
16. Showing Good Sportsmanship—Get an Extra Turn.
17. For a Poor Showing—Lose a Turn.
18.
19. For Extra Effort—Gain 3 points.
20. Fourth Place—Lose 1 point.
21. Bronze Medal
22. Silver Medal
23. Gold Medal In the principal course 11 around the perimeter of the board 10 the inscriptions for the play spaces include the following:

(a) In the right side column beginning at the top and reading downward to the lower right side corner the inscriptions for the spaces in sequence are:

START
YOU MADE THE TEAM 5 POINTS
COACHES PRAISE YOU 5 POINTS
GO TO THE WINTER SPORTS START
SPIN THE SPINNER MOVE AHEAD AMOUNT SHOWN
JIM THORPE SPECIAL AWARD 10 POINTS
TORCH RUNNER 5 POINTS
GO BACK 2 SPACES
GO TO ARENA SPORTS START
LIGHT OPENING FLAME 5 POINTS
YOU ARE A GOOD SPORT GO AHEAD 2 SPACES
REST AREA (b) In the bottom row beginning with the last space in the right side column and advancing in sequence from right to left, read:

REST AREA
GO TO WATER SPORTS START MUST CHALLENGE
FUTURE CHAMP 5 POINTS
GO TO TRACK AND FIELD START
SAFE AREA CANNOT BE CHALLENGED
GO TO ARENA SPORTS START
LATE FOR PRACTICE LOSE 5 POINTS
GO TO WINTER SPORTS START
ELECTED TEAM LEADER 5 POINTS
GO TO WATER SPORTS START
GO TO TRACK AND FIELD SPORTS START MUST CHALLENGE
LOSE A TURN (c) In the left side column beginning with the last space in the bottom row and advancing in sequence from bottom to top, read:

LOSE A TURN
YOU COACHED A WINNER 10 POINTS
GO TO WATER SPORTS START
GO BACK 2 SPACES
GO TO WINTER SPORTS START
GO AHEAD 2 SPACES
MOVE TO YOUR CHOICE OF GAME AREA START
SAFE AREA CANNOT BE CHALLENGED
SPIN THE SPINNER GO BACK AMOUNT SHOWN
GO TO TRACK AND FIELD START
EVENT CANCELLED LOSE 10 POINTS
GAIN A TURN ROLL AGAIN (d) In the top row beginning with the last space in the left-side column and advancing in sequence from left to right to the place of beginning, read:

GAIN A TURN ROLL AGAIN
GO TO ARENA SPORTS START MUST CHALLENGE
YOU ARE A FORMER CHAMP 5 POINTS
GO TO TRACK AND FIELD START
DEVELOPED YOUR TALENT 5 POINTS
SAFE AREA CANNOT BE CHALLENGED
GO TO WATER SPORTS START
SPIN THE SPINNER MOVE AHEAD AMOUNT SHOWN
GO TO ARENA SPORTS START
COMPETING IN YOUR SECOND OLYMPICS 10 POINTS
GO TO WINTER SPORTS START
START

The square Central area 13 has the word SPINNER in large red type on a white background along a diagonal from lower left corner to upper right corner. The border at the left side carries a copyright notice and an inscription in red on white O-LIMP-E-O reading downward from top toward the bottom, representing the name 22 of the game.

The board 10 may be constructed of various materials, such as bristolboard, cardboard, hardboard, metal, plastic and others, the only qualification being that the board shall be capable of displaying the game pattern thereon and that it provide a generally planar surface having stability for the movement of player pieces 25 during the game. In the preferred embodiment the spinner 24 is a separate device; however, it may be integrated with the board 10 as a permanent addition thereto without departing from the invention herein.

Figure 3:
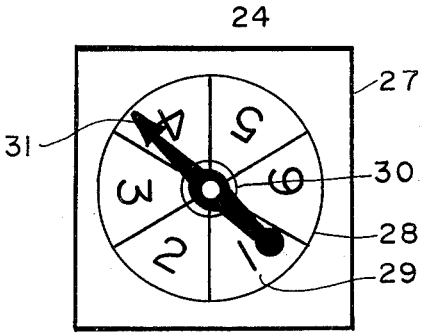
FIG. 3 is a top view of a spinner used in the game as a means of skill.
Figure 4:
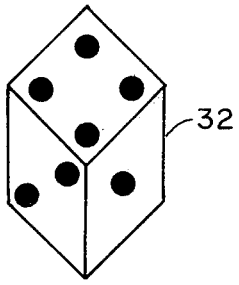
FIG. 4 is a pictorial representation of a die used in the game as a means of chance.
Figure 2:
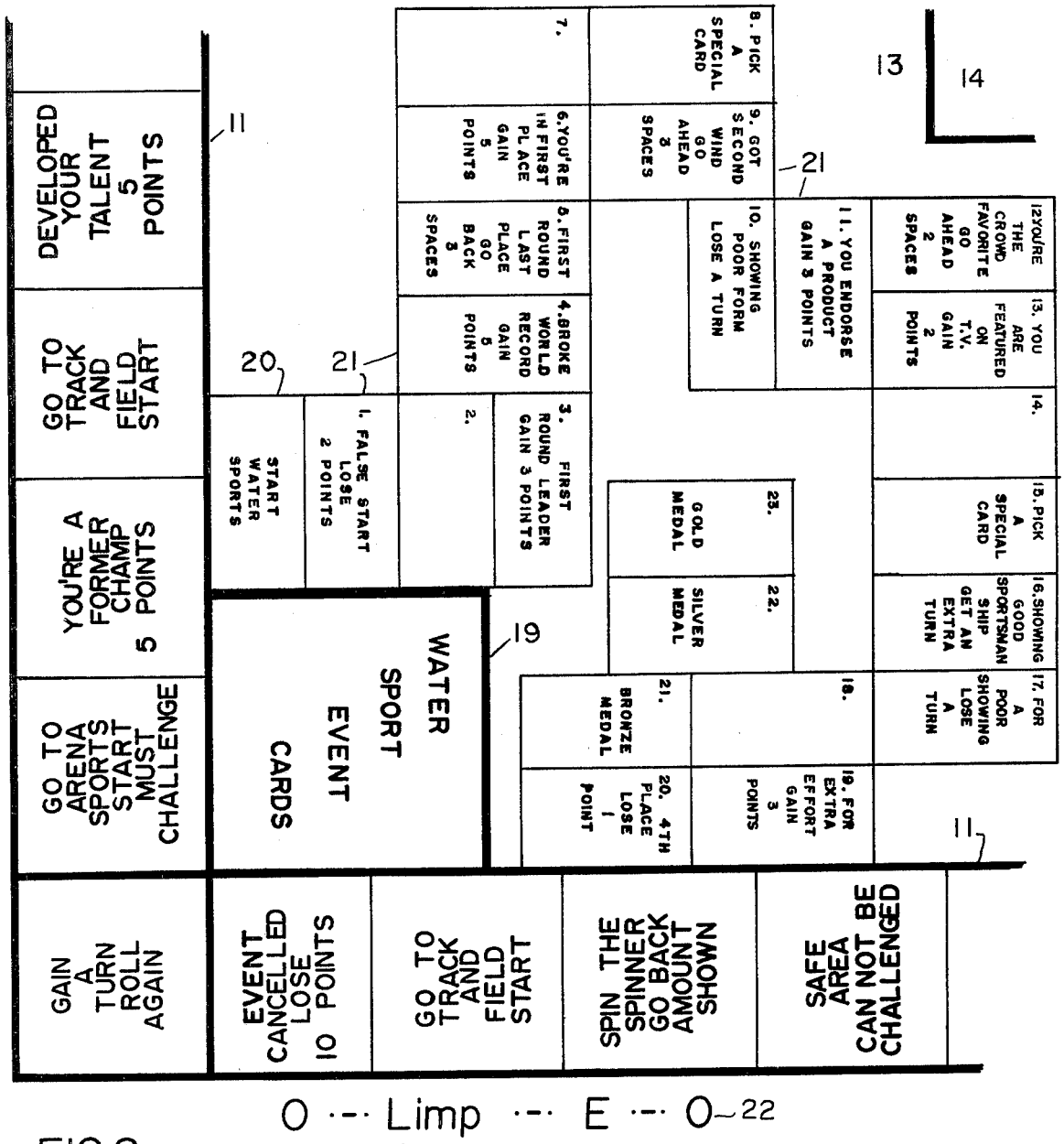
FIG. 2 is a top view showing a portion of the game board with indicia thereon for the playing spaces.

Referring now to FIG. 3 the spinner 24 comprises a base panel 27 upon which a circular pattern 28 provides a plurality of numbered segments 29. Support means, such as a bearing surface 30, and fastening means, such as a rivet or machine screw, attach needle 31 to the base panel 27 at the center of the circular pattern 28 so that an applied force will cause the needle 31 to spin on an axis perpendicular to the plane of the base panel 27 until friction stops the needle 31 at one of the numbered segments 29. Many other spinner configurations can be used as a means of skill. A standard die 32, shown in FIG. 4 is used as a means of chance, the sides of the cube having patterns of dots from one through six to represent numbers.

Figure 5:
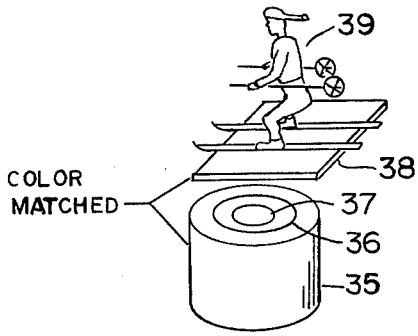
FIG. 5 shows a typical two-part magnetic player piece.

A plurality of marking pieces 25 one for each player is illustrated in FIG. 5. Each piece is in two parts, a pedestal 33 and a sports figurine 34, the color of each part being matched to uniquely identify the piece parts to an assigned player. A means of binding the pedestal 33 and the figurine 34 parts together is provided so that the combined piece 25 may be conveniently moved in game play as a single entity. The means of binding the piece parts together may be accomplished by various construction methods such as dovetail, Velcro hook and loop fastening fabrics, snap fastener, screw fastener, and magnetic attraction. The preferred embodiment for the present invention uses magnetic attraction between the pedestal 33 and the figurine 34. The pedestal 33 is comprised of a three dimensional base 35 made from ordinary rod or bar stock such as round, square, or triangular dowel materials. For magnetic attraction the top planar surface of the base 35 has attached thereto a ferrous washer 36, held captivated to the base 35 by a ferrous device such as a tack 37, or nail having a large head. The figurine 34 comprises a permanent magnet 38 having parallel planar surfaces for the top and bottom, thereof, and thickness sufficient for structural and magnetic integrity, typically in the range of 3/32 to $\frac{1}{8}$ inch, upon the top surface of which is permanently attached in the normal position a three-dimensional image 39 of one or more participants in a featured sports event. Attachment of the image 39 to the magnet 38 can employ various methods, although the preferred embodiment uses an adhesive cement. Each playing piece 25 will have a unique sports image 39, and further, to avoid player confusion the base 35 and magnet 38 of each piece 25 shall be of unique matched colors such as white, black, red or yellow, for example.

Figure 6:
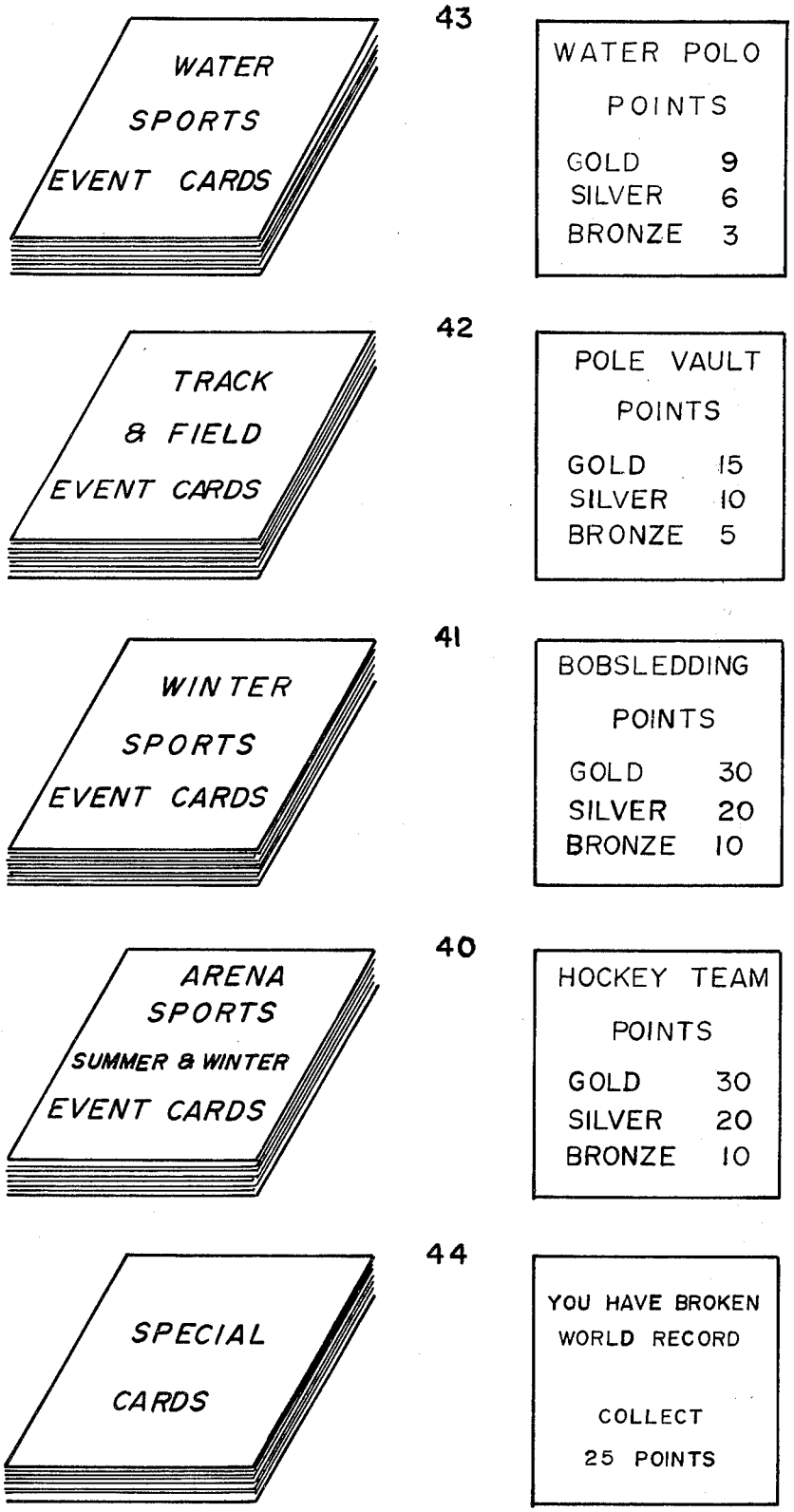
FIG. 6 illustrates the five decks of cards.

A plurality of card decks 26, FIG. 6, includes:

a. Cards for Arena Sports Events, Summer and Winter 40
b. Cards for Winter Sports Events 41
c. Cards for Track and Field Events 42
d. Cards for Water Sports Events 43
e. Special Cards 44
f. (Special Olympic History Cards 45)
g. (Special Sports Instructional Cards 46) Each deck has 21 cards. The obverse side carries an inscription indicating the event category and the reverse side presents the functional instructions for playing the O-LIMP-E-O game according to the listings presented below. The individual cards within each deck 26 will be printed on a material such as plastic or paper of a unique color for each special or event category. Although the present invention is not limited to specific inscriptions, and may be expanded without departure from the spirit of the present invention, the preferred embodiment described herein includes the following inscriptions:

Card Deck 40
Obverse sides: SPORTS SUMMER & WINTER ARENA

| | Reverse sides: | Points Gold | Silver | Bronze |
|---|---|---|---|---|
| 1. | Boxing "Heavy Weight" | 30 | 20 | 10 |
| 2. | Fencing Mens "Team Saber" | 9 | 6 | 3 |
| 3. | Fencing Womens "Team Foil" | 9 | 6 | 3 |
| 4. | Hockey Team | 30 | 20 | 10 |
| 5. | Figure Skating "Mens" | 9 | 6 | 3 |
| 6. | Figure Skating "Womens" | 9 | 6 | 3 |
| 7. | Figure Skating "Pairs" | 15 | 10 | 5 |
| 8. | Figure Skating "Dance" | 30 | 20 | 10 |
| 9. | Weight Lifting "Super Heavy" | 15 | 10 | 5 |
| 10. | Wrestling Freestyle "Heavy" | 30 | 20 | 10 |
| 11. | Wrestling Crew Roman "Super Heavy" | 30 | 20 | 10 |
| 12. | Gymnastics Mens "Floor Exercise" | 9 | 6 | 3 |
| 13. | Gymnastics Womens "Floor Exercise" | 9 | 6 | 3 |
| 14. | Gymnastics Mens "All Around" | 30 | 20 | 10 |
| 15. | Gymnastics Womens "All Around" | 30 | 20 | 10 |
| 16. | Balance Beam "Womens" | 15 | 10 | 5 |
| 17. | Horizontal Bars "Men" | 15 | 10 | 5 |
| 18. | Uneven Bars "Mens" | 15 | 10 | 5 |
| 19. | Parallel Bars "Mens" | 9 | 6 | 3 |
| 20. | Judo "Open" | 15 | 10 | 5 |
| 21. | Vault "Womens" | 15 | 10 | 5 |

Card Deck 41
Obverse sides: WINTER SPORTS EVENT CARD

| | Reverse sides: | Points Gold | Silver | Bronze |
|---|---|---|---|---|
| 1. | Speed Skating "Mens" 500 Meters | 9 | 6 | 3 |
| 2. | Speed Skating "Womens" 500 Meters | 9 | 6 | 3 |
| 3. | Speed Skating "Mens" 1500 Meters | 15 | 10 | 5 |
| 4. | Speed Skating "Womens" 1500 Meters | 15 | 10 | 5 |
| 5. | Speed Skating Mens 10,000 Meters | 30 | 20 | 10 |
| 6. | Speed Skating Womens 3,000 Meters | 30 | 20 | 10 |
| 7. | Biathlon Relay | 9 | 6 | 3 |
| 8. | Skiing Alpine Giant Slalom "Mens" | 30 | 20 | 10 |
| 9. | Skiing Alpine Giant Slalom "Womens" | 30 | 20 | 10 |
| 10. | Skiing Jumping 90 Meter Hill | 15 | 10 | 5 |
| 11. | Skiing Jumping 70 Meter Hill | 9 | 6 | 3 |
| 12. | Bobsledding | 30 | 20 | 10 |
| 13. | Biathlon | 30 | 20 | 10 |
| 14. | Luge "Mens" | 9 | 6 | 3 |
| 15. | Luge "Womens" | 9 | 6 | 3 |

-continued

Card Deck 41
Obverse sides: WINTER SPORTS EVENT CARD

| | Reverse sides: | Points Gold | Silver | Bronze |
|---|---|---|---|---|
| 16. | Cross Country Skiing Womens 10 KM | 9 | 6 | 3 |
| 17. | Skiing, Nordic "Mens" Combined 50 KM | 30 | 20 | 10 |
| 18. | Mens Skiing Downhill | 15 | 10 | 5 |
| 19. | Womens Skiing Downhill | 15 | 10 | 5 |
| 20. | Mens Slalom Skiing | 15 | 10 | 5 |
| 21. | Womens Slalom Skiing | 15 | 10 | 5 |

Card Deck 42
Obverse sides: TRACK & FIELD EVENT CARDS

| | Reverse sides: | Points Gold | Silver | Bronze |
|---|---|---|---|---|
| 1. | Decathlon "Mens" | 30 | 20 | 10 |
| 2. | Pentathlon "Womens" | 30 | 20 | 10 |
| 3. | Javelin Throw "Mens" | 9 | 6 | 3 |
| 4. | Javelin Throw "Womens" | 9 | 6 | 3 |
| 5. | Discus Throw "Mens" | 9 | 6 | 3 |
| 6. | Discus Throw "Womens" | 9 | 6 | 3 |
| 7. | Shot Put "Mens" | 9 | 6 | 3 |
| 8. | Shot Put "Womens" | 9 | 6 | 3 |
| 9. | 1600 Meter Relay "Mens" | 30 | 20 | 10 |
| 10. | 1600 Meter Relay "Womens" | 30 | 20 | 10 |
| 11. | 10,000 Meter Run | 30 | 20 | 10 |
| 12. | Marathon | 30 | 20 | 10 |
| 13. | Pole Vault | 15 | 10 | 5 |
| 14. | Long Jump "Mens" | 15 | 10 | 5 |
| 15. | Long Jump "Womens" | 15 | 10 | 5 |
| 16. | 100 Meter Dash "Mens" | 15 | 10 | 5 |
| 17. | 100 Meter Dash "Womens" | 15 | 10 | 5 |
| 18. | Volleyball | 9 | 6 | 3 |
| 19. | Soccer | 30 | 20 | 10 |
| 20. | 110 Meter Hurdles "Mens" | 15 | 10 | 5 |
| 21. | 100 Meter Hurdles "Womens" | 15 | 10 | 5 |

Card Deck 43
Obverse sides: WATER SPORTS EVENT CARD

| | Reverse sides: | Points Gold | Silver | Bronze |
|---|---|---|---|---|
| 1. | Rowing Womens Singles | 15 | 10 | 5 |
| 2. | Kayak Womens | 15 | 10 | 5 |
| 3. | Swimming Womens 800 Meter Freestyle | 30 | 20 | 10 |
| 4. | Kayak Mens | 15 | 10 | 5 |
| 5. | Rowing Mens Singles | 15 | 10 | 5 |
| 6. | Yachting | 30 | 20 | 10 |
| 7. | Canadian Canoeing | 15 | 10 | 5 |
| 8. | Swimming Womens 100 Meter Freestyle | 9 | 6 | 3 |
| 9. | Swimming Mens 100 Meter Freestyle | 9 | 6 | 3 |
| 10. | Swimming Mens 200 Meter Breast Stroke | 9 | 6 | 3 |
| 11. | Swimming Womens 200 Meter Breast Stroke | 9 | 6 | 3 |
| 12. | Swimming Womens 200 Meter Backstroke | 9 | 6 | 3 |
| 13. | Swimming Mens 200 Meter Backstroke | 9 | 6 | 3 |
| 14. | Swimming Mens 400 Meter Individual Medley | 30 | 20 | 10 |
| 15. | Swimming Womens 400 Meter Individual Medley | 30 | 20 | 10 |
| 16. | Swimming Mens 1500 Meter Freestyle | 30 | 20 | 10 |
| 17. | Spring Board Dive Mens | 15 | 10 | 5 |
| 18. | Spring Board Dive Womens | 15 | 10 | 5 |
| 19. | Platform Dive Womens | 30 | 20 | 10 |
| 20. | Platform Dive Mens | 30 | 20 | 10 |

-continued

Card Deck 43
Obverse sides: WATER SPORTS EVENT CARD

| | Reverse sides: | Points Gold | Silver | Bronze |
|---|---|---|---|---|
| 21. | Water Polo | 9 | 6 | 3 |

Card Deck 44

Obverse Sides: SPECIAL CARD

Reverse sides:

1. You have won event with gold medal, if you challenged or were challenged collect double point value for event. (Event is over all go back to place marker flag.)
2. You have won event with silver medal if you challenged or were challenged collect double point value for event. (Event is over all go back to place marker flag.)
3. You have won event with bronze medal if you challenged or were challenged collect double point value for event. (Event is over all go back to place marker flag.)
4. You have broken world record, collect 25 points.
5. You have lost event-if you challenged or were challenged opponent wins gold-regular points for event. (All go back to place marker flag.)
6. You have offers to turn pro, collect 20 points.
7. Your special talent is featured on TV. Collect 25 points.
8. For developing new training methods, collect 10 points.
9. For competing in more than one event collect 10 points.
10. Bad weather postpones your event, lose 15 points.
11. You commit an error, lose 10 points.
12. You are disqualified, lose 25 points.
13. For outstanding competitor collect 15 points.
14. For being in your second olympics collect 20 points.
15. You have won a bronze, silver and gold medal, collect 30 points.
16. Due to illness you drop out of competition, lose 10 points.
17. Right to refuse challenge-hold card until used. Replace on bottom of deck after use.
18. For promoting friendship collect 10 points.
19. Your opponent(s) lose one turn.
20. Your opponent(s) gain one turn.
21. You make your big move, go ahead 5 spaces.

GAME OBJECTIVE

The present invention has flexibility in the objective and method of game play so that variations can be introduced by the players, however, for the preferred embodiment described herein a first objective is to win by scoring the greatest amount of points within a preselected amount of playing time (example, 1 hr., 2 hrs.); a second objective is to win as the first player to score a set amount of points (examples, 300, 500); or a third objective may be to win as the first player to complete one or more passages of the primary playing course 11, returning to the START space 12.

METHOD OF PLAY

To begin the game matched playing pieces 25 are assigned to each player and all card decks 26 are shuffled. Card decks 26 and spinner 24 are positioned for play. Players may, for example, roll the die 32 to determine their order of play. All combined playing pieces 25 are positioned at the START space 12 of the principal course 11 at the upper right corner of the board 10. Players will roll the die 32 in turn and move the combined piece 25 a number of spaces indicated by the die 32. Each player must follow instructions inscribed on the spaces of the principal course 11 on which his piece 25 lands with regard to points earned, penalties, or directed further movement. If a player's piece 25 lands on a space among the plurality of spaces inscribed:

GO TO WINTER SPORTS START
GO TO ARENA SPORTS START
GO TO TRACK AND FIELD START
GO TO WATER SPORTS START
GO TO WATER SPORTS START MUST CHALLENGE
GO TO TRACK AND FIELD SPORTS START MUST CHALLENGE
GO TO ARENA SPORTS START MUST CHALLENGE that player must separate his playing piece 25 into its two component parts, leaving the pedestal 33 on the last space reached in play on the primary course 11 and moving the figurine 34 to the start space 20 of the appropriate secondary course 21 for play related to the designated SPORTS EVENT. The pedestal 33 marks the space to which the player returns when he completes play in a SPORTS EVENT.

When a player goes to a secondary course 21 for SPORTS EVENT play he turns the top card for that event face up to determine value of medals in a competitive sport thereby selected. On the secondary course 21 and beginning with the player's next regular turn the spinner 24 is used to determine the number of spaces to advance in each move. Again a player must follow instructions as inscribed on the spaces of the secondary course 21. Players have five (5) turns at play in SPORTS EVENTS to win a medal; i.e. to reach numbered spaces #21, #22, or #23 for bronze, silver or gold medals respectively. If no player reaches a medal in five (5) turns the event contest is over and player figurine pieces 34 are returned to the principal course 11 to the space marked by the matching pedestal 33, from which regular play resumes.

On the Events (secondary) course 21, if a player arrives at space #20 or lower and he has a turn or turns left he spins spinner 24. If spinner stops on 4, 5 or 6 the player may move to the bronze medal. If a player arrives at a bronze or silver medal and still has turns left he may try for a 1 or 2 on the spinner 24, but if a higher number results he may not advance.

When a player first moves to a SPORTS EVENT, i.e., a secondary course 21, he may at his option, CHALLENGE any other player or players that are available to competition in the EVENT. Players that are already in an EVENT or situated on a sanctuary or safe space of the primary course 11 cannot be challenged; otherwise challenged players must accept with one exception. If a player arrives at a "must challenge" space of the primary course 11, then it is mandatory that he challenge all available players.

During a challenge match a player that reaches the highest value medal wins the EVENT. The winning player in competition receives double the points indicated for the sport for that medal. Losers must deduct the amount of points that the medal winning player landed on. If no player reaches a metal within (5 turns) regular play the EVENT ends with no penalty to any player and the players resume on the principal course 11. When an EVENT is over the event card is turned face down and placed on bottom of the appropriate card deck 26.

Two or more spaces of the secondary courses 21 will require a player arriving thereon to pick a card from SPECIAL DECK. The player must follow instructions as to awards penalties or directed moves. If the player draws a "right to refuse challenge" card, he may hold it until he wants to use it, but after its use it must be turned face down and be returned to the bottom of the SPECIAL DECK.

Having described the invention, it is to be understood that variations may be made without departing from the invention disclosed and specified herein.

I claim:

1. An olympic sports game apparatus with elements of chance and tests of individual skill, for competitive play by a plurality of individuals, said game apparatus having a playing board, a closed primary playing course, for use by all players, at the periphery of said playing board, said primary course divided into a succession of contigious playing spaces that are inscribed with randomly unique information granting awards, imposing penalties, providing sanctuaries, and instructing game play, a plurality of distinctively marked secondary playing courses for individual and challenged play thereon, said secondary courses arranged upon a central area of said playing board, each said secondary playing course featuring a major classification of related olympic sports, each said secondary playing course being divided into a randomly oriented succession of numbered contigious playing spaces wherein said numbered playing spaces are inscribed with randomly varying informations granting awards, imposing penalties, and instructing secondary course game play, a combination of means for regulating movements of said players upon said primary and said secondary courses for play, and means for displaying, upon said primary and said secondary courses, the positions of each said player during all turns at play, wherein the improvement comprises:

(a). a first combination of chance and skill apparatus for regulating play upon said primary course, said first combination further comprising printed instructions for game play randomly distributed among said playing spaces of said primary course, a die for providing a further element of chance, and a spinner for providing a test of said players' individual skills;

(b). a second combination of chance and skill apparatus for regulating play upon said plurality of secondary course, said second combination further comprising at least one of said numbered spaces of said secondary courses having instructions for play thereon, a deck of special cards for assigning points and for specifying player movements, a plurality of decks of event cards, a deck thereof distinctively marked to correspond to each secondary course, said event cards for identifying specific olympic games to be played and for setting winning point values, and a spinner for a test of said players' individual skills; and (c). a plurality of two-part playing pieces for displaying player' positions upon said primary and said secondary courses, during turns at play, each said two-part playing piece uniquely colored so as to idenfify its assigned player, said two-part playing piece for use as a combined entity to mark player position, during play, on said primary course, said two-part playing piece for use, during intervals of game play on said secondary courses, as separated entities, firstly, to mark said player's last position on said primary course, and secondly, to mark said player's then current progress on said secondary course, a first part of said two-part playing piece being a pedestal, and a second part of said two-part piece being an artistic sports figurine, said pedestal and said figurine having bonding means for temporary assembly by said player of said combined entity.

2. An olympic sports game apparatus according to claim 1, wherein the bottom of said figurine comprises a permanent magnet adhesively fixed thereto; the top of said pedestal comprises a washer fixed to said pedestal by a tack; the attraction between said magnet and combination of said tack and said washer serving as said bonding means for detachably joining said figurine and said pedestal so as to form a composite marker for use as said combined entity for marking play position on said primary course.

* * * * *